US006741174B2

(12) United States Patent
Rhoades et al.

(10) Patent No.: US 6,741,174 B2
(45) Date of Patent: May 25, 2004

(54) ENVIRONMENT AND HAZARD CONDITION MONITORING SYSTEM

(75) Inventors: Doug Rhoades, Escondido, CA (US); Gregg Morgan, Carlsbad, CA (US); Walter Smith, Fredericksburg, VA (US)

(73) Assignee: Ocean Systems Engineering Corporation, Carlsbad, CA (US)

( * ) Notice: Subject to any disclaimer, the term of this patent is extended or adjusted under 35 U.S.C. 154(b) by 191 days.

(21) Appl. No.: 10/016,185

(22) Filed: Oct. 30, 2001

(65) Prior Publication Data

US 2002/0050932 A1 May 2, 2002

Related U.S. Application Data

(60) Provisional application No. 60/244,462, filed on Oct. 30, 2000.

(51) Int. Cl.[7] ..... G08B 21/00

(52) U.S. Cl. ..... 340/540; 340/3.1; 340/286.02; 340/506; 340/517; 340/539.26; 340/825.5; 700/17; 709/318

(58) Field of Search ..... 340/540, 506, 340/539.1, 531, 539.18, 517, 539.26, 825.5, 825.36, 465, 528, 629, 632, 931, 286.02, 286.05, 3.1, 628; 700/18, 17; 709/317, 318

(56) References Cited

U.S. PATENT DOCUMENTS

| | | | | |
|---|---|---|---|---|
| 4,567,557 A | | 1/1986 | Burns | |
| 5,889,468 A | * | 3/1999 | Banga | 340/628 |
| 5,977,913 A | * | 11/1999 | Christ | 340/825.36 |
| 6,134,303 A | | 10/2000 | Chen | |
| 6,215,404 B1 | | 4/2001 | Morales | |
| 6,320,501 B1 | | 11/2001 | Tice et al. | |
| 6,369,706 B1 | * | 4/2002 | Anderson et al. | 340/521 |
| 6,392,692 B1 | * | 5/2002 | Monroe | 340/506 |

* cited by examiner

*Primary Examiner*—Davetta W. Goines
(74) *Attorney, Agent, or Firm*—Baker & McKenzie

(57) ABSTRACT

An environment and hazard condition monitoring system is provided. One embodiment of the environment monitoring system is adapted to incorporate a plurality of preexisting sensors. The environment monitoring system comprises at least one user interface and a plurality of sensor agents, with each sensor agent communicating with the preexisting sensors, the user interface and with the other sensor agents. Another embodiment of the invention provides new sensors that include sensor agents that can communicate with each other and with a user interface. The sensor agent in either environment monitoring system can also communicate with portable devices.

46 Claims, 5 Drawing Sheets

10
USER INTERFACE
USER INTERFACE
USER INTERFACE
35
35
35
30
30
30
LOCAL AREA NETWORK
30
SENSOR AGENT
SENSOR AGENT
SENSOR AGENT
SENSOR AGENT
20
20
20
20
45
45
45
PORTABLE DEVICE
40
25
25
S
15

ENVIRONMENT AND HAZARD CONDITION MONITORING SYSTEM

This application claims priority from U.S. Provisional Application Serial No. 60/244,462, filed Oct. 30, 2000, entitled ENVIRONMENT AND HAZARD CONDITION MONITORING SYSTEM, which is incorporated herein by reference in its entirety.

FIELD OF THE INVENTION

The present invention relates to sensor systems. In particular, the present invention relates to a system for monitoring environmental conditions.

BACKGROUND OF THE INVENTION

Environment monitoring systems are commonly found in ships, buildings and other structures that must be monitored for safety and other purposes. The compartments in these structures and vessels may be monitored for obvious hazards, such as fire, flooding or noxious gases. Other compartments may need to be maintained at specific temperatures and/or humidity levels to accommodate particular goods or devices. For example, computer systems may require reduced temperatures, and perishable items may have specific humidity requirements. Generally, the monitoring system sensors generate an alarm to alert operators to a change in the status of the environment.

Generally, an environment monitoring system has a central operator interface that displays the status of the system. This requires an operator to be present at the interface, or nearby to detect an alarm signal. Other systems have the capability of sending an alarm signal to other locations, such as a fire station. One disadvantage of these systems is that access to the status of the sensors is limited to one, or a very few locations where an interface is installed.

In addition, as the building or ship ages, the monitoring system also ages. However, these structures or vessels may be subject to new regulatory requirements and building owners or ship operators may need to provide information to regulatory agencies regarding the quality of the environment within various compartments. In some cases, an older environment monitoring system may need to be replaced. Replacement of a system that includes hundreds of sensors can be extremely costly to the ship or building owner.

Therefore, there exists a need for an environment monitoring system that can augment existing systems and that can provide access to the monitoring system at a plurality of locations.

SUMMARY OF THE INVENTION

In order to overcome the deficiencies with known, conventional environment monitoring systems, an environment and hazard condition monitoring system is provided. Briefly, one embodiment of the environment monitoring system is configured to incorporate a plurality of preexisting, or preinstalled sensors. The environment monitoring system includes sensor agents that communicate with the preexisting sensors and with other sensor agents and portable user interfaces or devices. The present invention can augment existing environment monitoring systems to increase the capabilities and functional features of the existing system, thereby eliminating the need for a costly, wholesale replacement.

More specifically, one embodiment of the present invention employs at least one user interface and a plurality of sensor agents. The sensor agents are structured to communicate with a plurality of preexisting sensors and with the user interface. One feature of the present invention is that the sensor agents can communicate with each other, as well as with portable devices that can be carried by building maintenance people or shipboard operators.

One envisioned embodiment of the environment monitoring system of the present invention can be installed on a ship. One feature of the system is that if the user interface becomes inaccessible during an emergency, the environment monitoring system can be accessed by portable user interfaces, which can access sensor data throughout the ship by communicating with the sensor agents.

DETAILED DESCRIPTION OF THE INVENTION

In the following paragraphs, the present invention will be described in detail by way of example with reference to the attached drawings. Throughout this description, the preferred embodiment and examples shown should be considered as exemplars, rather than as limitations on the present invention. As used herein, "the present invention" refers to any one of the embodiments of the invention described herein, and any equivalents.

One embodiment of the present invention is designed for installation on ships as an integrated ship survivability system. It will be appreciated that alternative embodiments of the present invention can be installed in buildings, aircraft, spacecraft, factories, subways, trains, power generating stations, or in any other structure or craft that requires monitoring of the environment. The present invention enables the integration of large numbers of sensors into a networked system that is capable of processing, analyzing, and presenting data received from the sensors in a timely and useful way. The present invention may also activate various suppression, or other systems in response to data received from the sensors. For example, the system may activate fire suppression devices, alarms, and other suitable devices.

The present invention may be understood as establishing a virtual extension of an operator's senses into the monitored space. This extension of an operator into a compartment or space is accomplished in several ways. One embodiment of the present invention can be configured to cooperate with preexisting, or legacy sensors that have been previously installed. In this situation, a sensor agent would communicate with the legacy sensors. A group of sensor agents would be installed in a system having a large number of preexisting sensors. Each of the sensor agents may communicate with each other via a sub-network that may be operated and accessed discretely from the previously installed hardwired network. For example, a sensor agent that is located in a specific monitored space may communicate with other sensors in that area as well as with sensor agents located in other rooms or spaces. Communication with the sensor agents may be achieved though stationary user interfaces or though portable user interfaces. The portable user interfaces allow a user to obtain sensor data in any location within a building, ship, train, subway or other installation employing the present invention. This can be extremely advantageous in situations where the preinstalled user interface is not accessible.

Another embodiment of the present invention is configured for installation in the absence of any preexisting sensors, that is, as an "original equipment" environment monitoring system.

Both systems can be designed to work with sensor agents that include a moveable camera that sends video data to the previously installed user interface or to other interfaces located in the building or vessel or to a portable user interface.

Figure 1:
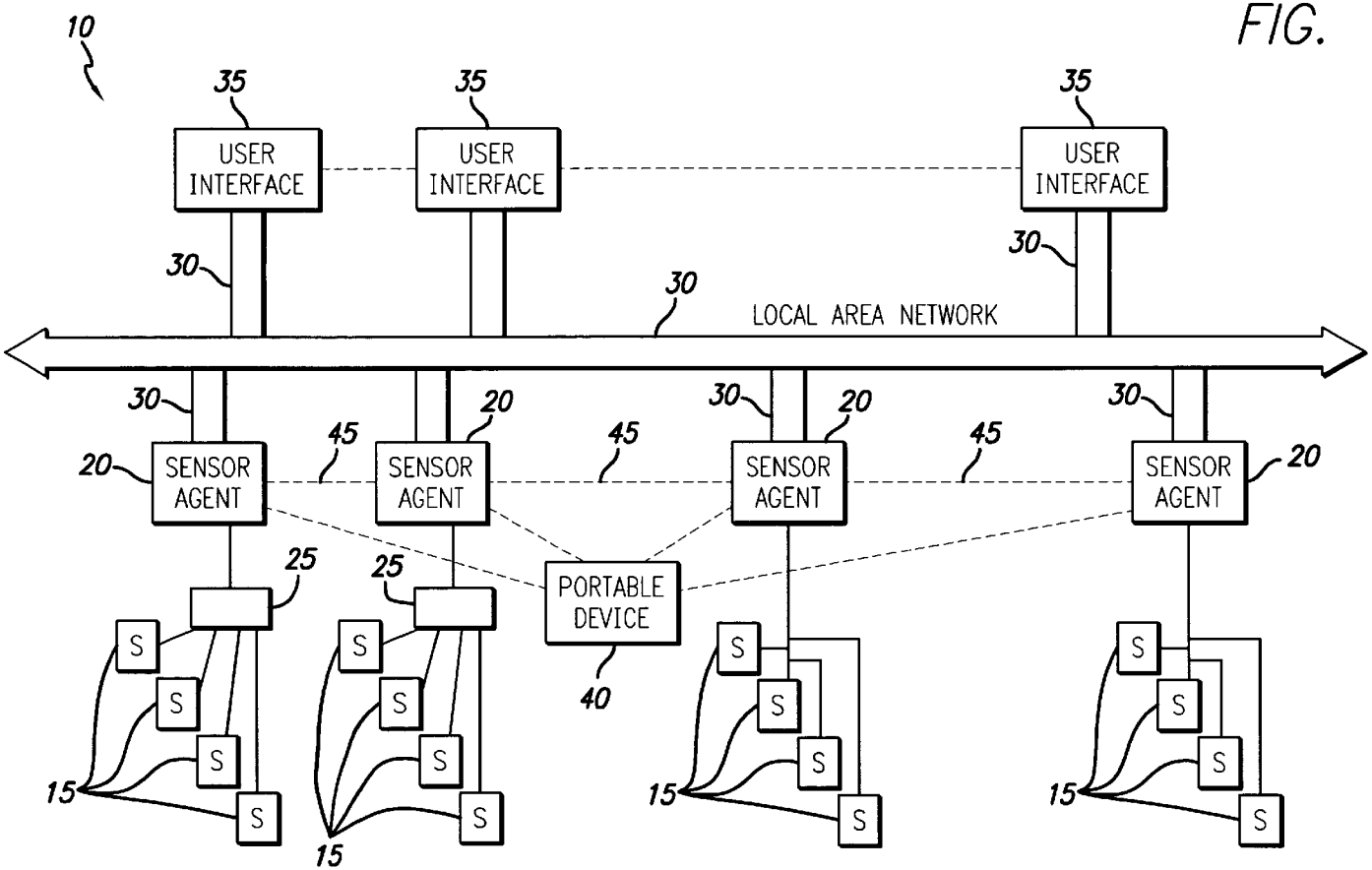
FIG. 1 is a schematic illustration of one embodiment of the environment and hazard condition monitoring system constructed according to the present invention.

Referring to FIG. 1, a schematic illustration of one embodiment of the environment monitoring system 10 constructed according to the present invention is illustrated. A multiplicity of preexisting, or legacy sensors 15 are located in various compartments or spaces of interest in a building or ship. The sensors 15 may be preexisting sensors that have been installed as part of a older monitoring system, or in another embodiment of the present invention, the sensors 15 may be new sensors installed as part of a new environment monitoring system. The present invention can communicate with any type of sensor, including temperature sensors, smoke sensors, explosive gas sensors, poisonous gas sensors, carbon monoxide sensors, chlorine gas sensors, nitrogen sensors, passive infrared sensors, water sensors, flooding sensors, atmospheric pressure sensors, humidity sensors, and other sensors.

Sensor agent 20 is structured to communicate with a group of sensors 15. For example, a specific compartment may contain a plurality of sensors to sense different environmental conditions and the sensor agent 20 may be located in the compartment where it will communicate with all of the sensors 15. The sensor agent 20 can also be located outside of the compartment where the sensors 15 are located. As shown in FIG. 1, a plurality of sensor agents 20 may be required to communicate with a multiplicity of sensors 15 located throughout a building, ship, aircraft, spacecraft, factory, subway, train, power generating station, or other structure or craft.

Each sensor agent 20 communicates with a user interface 35 through a local area network (LAN) or first network 30. The first network 30 may either be a shared network or a dedicated network and it may be constructed of fiber, copper or it may be a wireless network. In a preferred embodiment, the environment monitoring system 30 will employ an existing network that was installed during the construction of the building or ship.

One or more user interfaces 35 may be located in different areas of the structure or vessel. For example, if the environment monitoring system 10 is installed in a ship, one or more user interfaces 35 may be located on the bridge, the engineer's office and the central control compartment. Each user interface 35 may include a computer system, such as a personal computer, computer workstation, or other general computing device, that will include a monitor, keyboard, mouse, touch pad, a processing unit, memory, and computer program or software storage means, such as a hard drive or CD-ROM. In one embodiment of the present invention, the sensor agents 20 will have the capability to communicate with the user interface 35 through a wireless network if the first network 30 is disabled. For example, if the first network 30 is a hardwired system, then should connectivity through that system be lost, communication between the sensor agent 20 and the user interface 35 will automatically switch to a wireless network until the first network 30 is restored.

Figure 2:
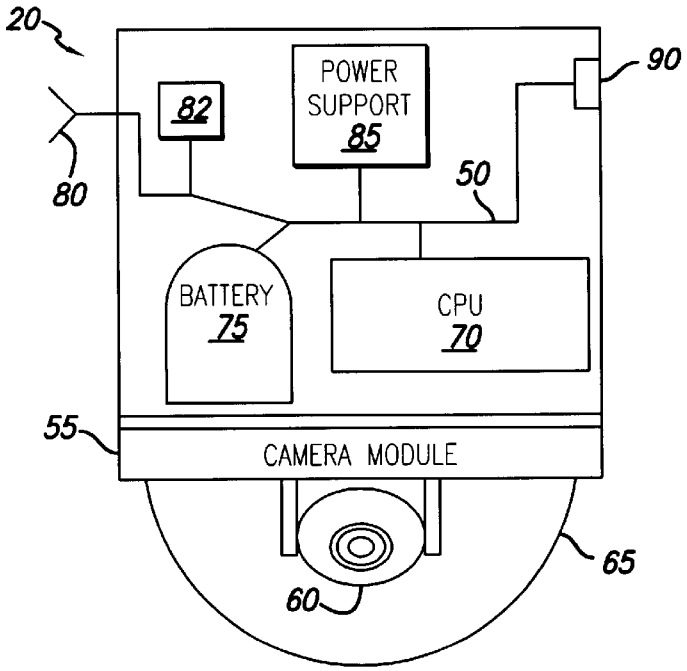
FIG. 2 is a plan view of one embodiment of a sensor agent illustrated in FIG. 1.

Referring now to FIG. 2, a sensor agent 20 is illustrated. The sensor agent 20 provides a distributed processing capability to the environment monitoring system 10. Specifically, each sensor agent 20 includes a general computing device or processing unit 70 that permits the sensor agent 20 to monitor the sensors 15 and evaluate the data received from the sensors 15 according to filter and alarm criteria received from the user interface 35 or, preferably, located on the sensor agent 20. This minimizes the use and traffic experienced by the first network 30. The features incorporated in the sensor agent 20, described below, allow the sensor agent 20 to manage the plurality of sensors 15. In one embodiment, communication between the sensor agent 20 and the sensors 15 is wireless. The sensor agent 20 only broadcasts an alarm message on the first network 30 when it receives a signal from the sensors 15 that are out-of-tolerance. Preferably, the only communication that occurs between the sensor agent 20 and the user interface 35 over the first network 30 is a periodic "all okay" that establishes that the sensor agent 20 is operating and that the sensors 15 are not sending any out-of-tolerance data.

In a preferred embodiment of the environment monitoring system 10, the sensor agent 20 performs several functions. The sensor agent 20 acts as a sensor host by providing a connection between the sensors 15 and the user interface 35. Specifically, the sensor agent 20 can provide a hardwired or wireless communication capability to the user interface 35. The sensor agent 20 can communicate via the first network 30 that is hardwired to the user interface 35, or a wireless communication link can be established to the user interface 35. Communication between the sensor agent 20 and the user interface 35 allows the user interface 35 to receive status reports from the sensors 15 via the sensor agent 20, set filter and alarm criteria parameters for the sensors 15 via the sensor agent 20, verify sensor 15 health, conduct sensor 15 diagnostics, and in one embodiment of the sensor agent 20 that includes a video capability, stream video and audio data to the user interface 35. For example, the sensor agent 20 may provide video verification of an alarm condition. In addition, the sensor agent 20 may include programmed logic that will allow the sensor agent 20 to activate damage suppression and mitigation devices in accordance with the program. For example, the sensor agent 20 may activate fire suppression if data received from the sensors 15 indicates a fire is present.

One embodiment of the sensor agent 20 is illustrated in FIG. 2. The sensor agent 20 includes a general computing device or processing unit 70, a power support system 85, a battery 75, a memory module 82, one or more connectors 90, an antenna 80, and a camera module 55 that includes a camera 60 and a housing 65. A bus 50 interconnects the various components allowing them to communicate as necessary. In one embodiment, the processing unit 70 is an integrated single chip such as the INTEL 82559er (INTEL is a registered trademark of Intel Corporation of Delaware). Alternatively, the processing unit 70 may comprise a PENTIUM-class single-chip microcomputer capable of operating at 133 megahertz or greater on 2.8 watts or less (PENTIUM is a registered trademark of Intel Corporation of Delaware). Those skilled in the art will appreciate that other processing units can also be employed.

The power support 85 provides power and charges the battery 75. The power support 85 supplies capacity to operate all of the sensor agent 20 capabilities including any power required for operation of the camera module 55. In one embodiment, the power support 85 will receive power from the building or ship. Another embodiment power support 85 includes a photovoltaic cell that obtains energy from the compartment or space lighting. This energy can be stored in the battery 75. In addition, the battery 75 is sized to enable the sensor agent 20 to operate for at least 12 hours, and in one embodiment, 18 hours. This allows the sensor agent 20 to operate even when a power outage occurs in the building or ship. The connector 90 may be comprised of one or more connectors, such as parallel ports, standard serial ports, keyboard or mouse inputs, USB serial ports, Ethernet ports or other suitable connectors or ports for connecting the sensor agent 20 to the sensor 15 and to the first network 30.

The memory 82 may include random access memory (RAM), flash RAM, dynamic RAM (DRAM), synchronous DRAM (SDRAM), or other suitable types of memory. Antennae 80 may comprise one or more antenna for providing wireless communication between the sensor agent 20 and other sensor agents 20, the user interface 35, other sensors 15 that are capable of wireless communication and to a portable device or user interface 40. The antenna 80 may be an Ethernet antenna, a BLUETOOTH antenna, an ultra-wideband antenna or other antennae that support wireless communication protocols such as 802.11, 10Base-T, 100Base-T, 100Base-FX or other wireless protocols (BLUETOOTH is a registered trademark of Ericsson Corporation of Sweden).

A preferred embodiment sensor agent 20 may include a camera module 55 that comprises a camera 60 and a housing 65. Preferably, the housing 65 is pressure resistant and can survive elevated temperatures, and may be constructed of glass, plastics, polycarbonate resins or other suitable materials. Preferably, the camera 60 is a digital camera that can be remotely operated from the user interface 35 or from a portable device 40. The camera 60 may include a pan motor, a tilt motor, and control logic that employs azimuth and tilt feedback.

In one embodiment, the sensor agent 20 may be "field replaceable." In this embodiment, the sensor agent 20 may include quick release connectors or be otherwise configured so that a damaged sensor agent 20 may be replaced in two hours or less. The sensor agent 20 is capable of operation in temperatures ranging between 5° centigrade and 50° centigrade and in all humidity levels up to 100% humidity. The sensor agent 20 is designed to withstand voltage variations, vibration, shock and impacts that may be experienced onboard a ship, train, subway, spacecraft or other vehicle.

One feature of the sensor agent 20 that includes a camera module 55 is that if a sensor 15 sends an out-of-tolerance signal to the sensor agent 20, the sensor agent 20 will relay the out-of-tolerance signal to the user interface 35 where a user can access video data from the sensor agent 20 to verify the cause of the out-of-tolerance signal. This feature minimizes the effect of false alarms while assuring that every alarm condition is quickly verified.

Figure 3:
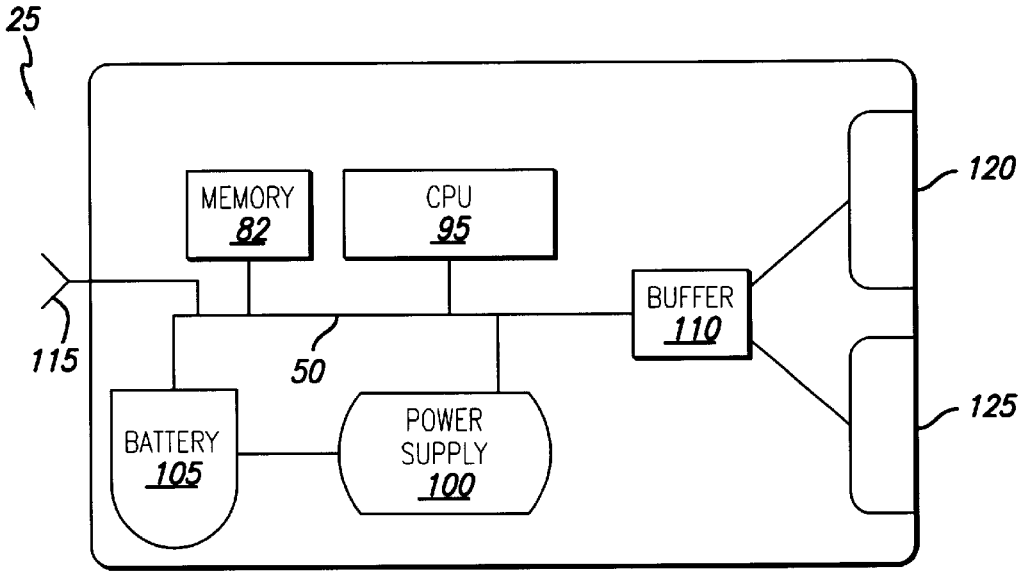
FIG. 3 is a plan view of one embodiment of a sensor interface illustrated in FIG. 1.

Referring now to FIG. 1, an alternative embodiment of the environment monitoring system 10 may include one or more sensor interfaces 25. The sensor interface 25 establishes communication between the sensor agent 20 and preexisting or legacy sensors 15. Preferably the sensor interface 25 may connect several hardwired and/or wireless sensors to a single sensor agent 20. In one embodiment, the sensor interface 25 would comprise a low-power energy-scavenging device that attaches to the existing legacy sensor 15. This sensor interface 25 would power a hardwired legacy sensor 15 in the case of a power failure. As shown in FIG. 3, the sensor interface 25 includes a power supply 100 that may comprise a photovoltaic cell that is capable of obtaining energy from the compartment lighting. The energy obtained can be stored in battery 105 for later use to power the sensor interface 25 up to 12 hours, and preferably 18 hours in case of a power failure. In one embodiment, the sensor interface 25 also includes a processing unit 95, a memory module 82, a buffer 110 and a communication bus 50. The sensor interface 25 may also include one or more analog ports 120 and one or more digital or discrete input and output ports 125. An exemplary installation of the sensor interface 25 will have the preexisting or legacy sensors 15 coupled to the sensor interface 25 through the analog port 120 or the digital port 125. If necessary, a buffer 110 will adjust the speed of the data received from the legacy sensors 25. As discussed above in connection with the sensor agent 20, the antenna 115 may include one or more antennae configured to transmit BLUETOOTH protocols, various Ethernet protocols or ultra-wideband wireless communication protocols.

The sensor interface 25 is designed to interface with preexisting or legacy sensors 15. This is necessary when the environment monitoring system 10 is installed as part of a back-fit or retrofit of an existing environment monitoring system. It is also envisioned that the environment monitoring system 10 will be installed as "original equipment" in a building or ship. In this case, the sensor interface 25 may not be required. For example, an environment monitoring system installed as "original equipment" in a ship may employ a plurality of combined function sensors that perform the functions of both the sensors 15 and the sensor agents 20.

Figure 5:
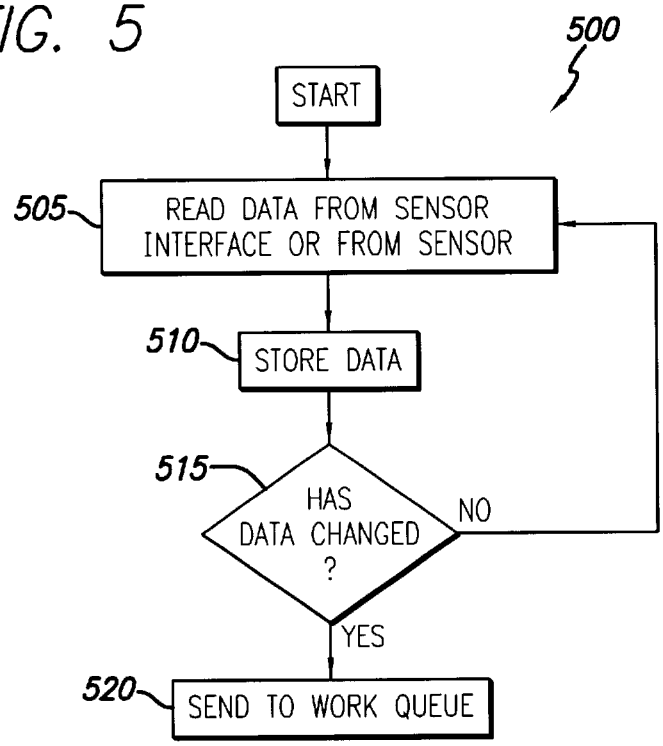
FIG. 5 is a flowchart illustrating one possible method of data generation by the sensor agent illustrated in FIG. 1.
Figure 6:
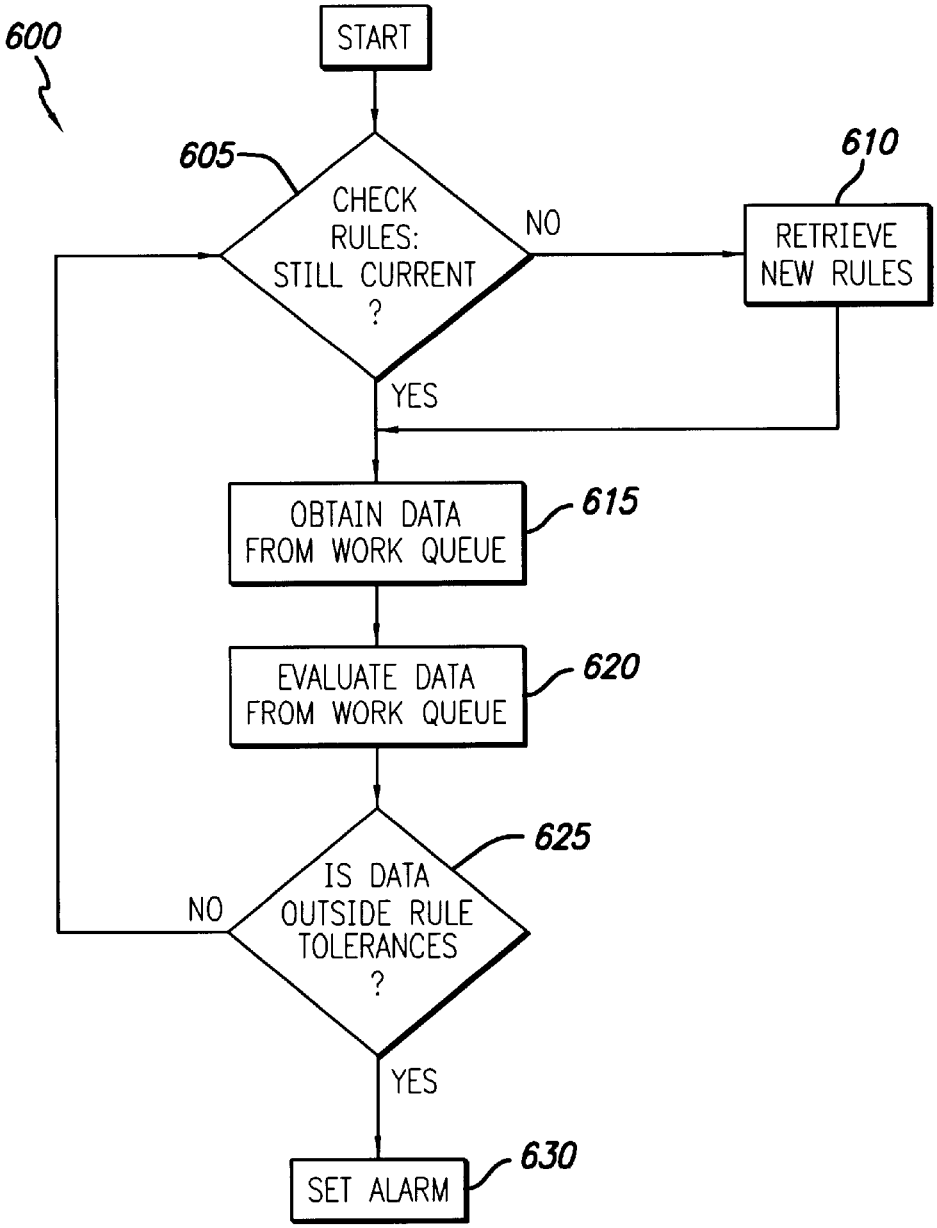
FIG. 6 is a flowchart illustrating one possible method of evaluating sensor data.

FIGS. 5–6 illustrate flowcharts that portray methods for operating the present invention. One component of the present invention is a computer software program, which may reside on any one of, or a combination of, the user interface 35, the sensor agent 20 and the portable device 40. The software may be compatible with a number of different computer operating systems such as Linux, WINDOWS 9X, WINDOWS NT and various real-time operating systems (WINDOWS is a trademark of Microsoft Corporation of Washington).

One feature of the present invention is that users can generate rule sets that can be used to screen data received from the sensors. These rule sets can be tailored to monitor specific environmental conditions of interest to each user. For example, a fire safety officer on a ship may want to know when the temperature in a compartment is rising at greater than two degrees per minute. A cargo officer may want to know the temperature and humidity in a cargo space, or a representative from the Department of Labor's Office of Safety and Health Administration may want to know whether or not carbon monoxide or other dangerous gases are present in workspaces. The present invention permits these and other individuals having specific information needs to quickly and easily generate rules that will filter the data received from the sensors to suit their needs. Each sensor 15 generates data which is received by either the sensor agent 20 or by the sensor interface 25. If received by a sensor interface 25, the sensor data is then forwarded to the sensor agent 20. The sensor data may then be forwarded to the user interface 35 or to the portable device 40.

One feature of the present invention is that the portable device 40 can be used to access the sensor agent 20 through sub-network or second network 45. Because each of the sensor agents 20 is capable of wireless communication with the other sensor agents 20, a sub-network 45 may be established between all of the sensor agents 20. And because the sensor agents 20 communicate with all of the sensors 15, this sub-network 45 can provide data from all of the sensors 15 onboard the ship or in the building. The sub-network 45 can be accessed through a sensor agent 20 by portable device 40. This allows a user to access the environment monitoring system 10 through any sensor agent 20. This feature can be extremely useful in situations where the user interface 35 can no longer be accessed as a result of a fire or damage to a ship compartment. This increases the flexibility of the environment monitoring system 10 as a user with a portable device 40 can access the environment monitoring system 10 at virtually any location within the building or ship or other vehicle or structure in which the environment monitoring system 10 is installed. The portable device 40 may be any device containing an antenna and the necessary wireless communication protocols for communicating with the sensor agent 20. For example, the portable device 40 could be a portable digital assistant, a cellular phone, a laptop computer, or any other portable device having a wireless communication capability.

Figure 4:
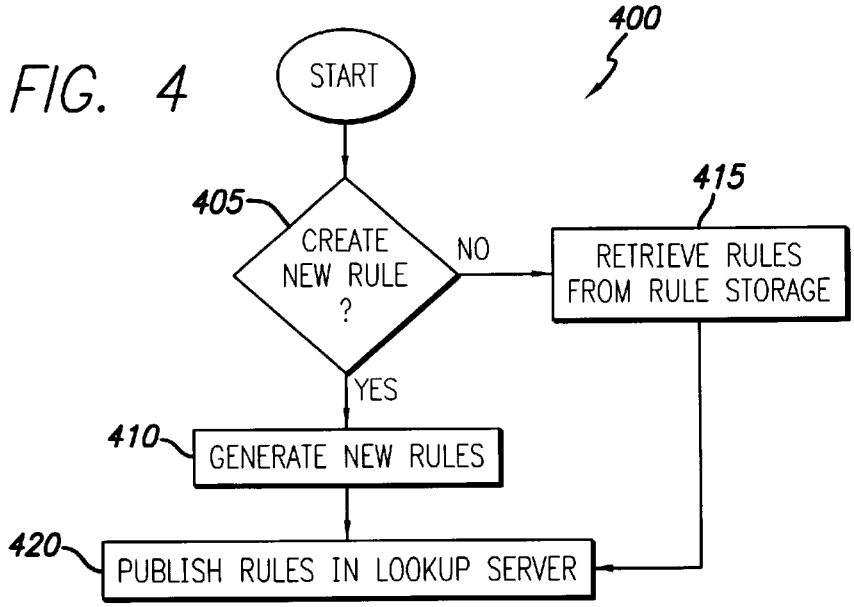
FIG. 4 is a flowchart illustrating one possible method of creating a sensor rule set.

FIG. 4 illustrates a flowchart used to create or retrieve one or more rules used to filter all of the data received from the sensors 15. As discussed above, the present invention allows different users to establish rule sets for filtering data received from the sensors 15. This increases the efficiency of the environment monitoring system 10, as users will not be forced to sort through all of the data generated by the sensors 15, but instead can establish rule sets to filter the data so that only sensor data of interest to them will be presented. A user accessing either the user interface 35 or a portable device 40 will start at step 405 and determine whether or not a new rule must be created or if a rule or rule set must be retrieved from rule storage 415. If a new rule is to be created in step 410, the user will generate a new rule or rule set and in step 420, the rule or rule set will be published in a look-up server. In a preferred embodiment, the look-up server is not a physical device but is software in the form of a computer program. In a preferred embodiment, the look-up server comprises JINI software architecture that employs JAVA computer programming language (JINI and JAVA are registered trademarks of Sun Microsystems of Delaware).

As a user generates a new rule, the rule is "compiled" and forwarded to the look-up server. The look-up server may be located on the sensor agent 20, the user interface 35 or on the portable device 40. If the look-up server is located on the user interface 35 or the portable device 40, the sensor agents 20 will download the rules and use the rules to filter the data obtained from the sensors 15. Alternatively, the user interface 35 or the portable device 40 may execute the rules and access the data from the sensors 15. This is illustrated in the FIG. 5 flowchart. The sensor agent 20, the user interface 35 or the portable device 40 reads the data from the sensor interface 25 or the sensor 20 in step 505. The data is then stored in step 510 and in step 515, the data is evaluated for any changes. If the data has not changed, then the sensor agent 20, portable device 40 or the user interface 35 waits and reads new data received from either the sensor interface 25 or from the sensor 20. If the data value from the sensor interface 25 or sensor 20 does change, the new data is sent to a work queue in step 520.

Referring to FIG. 6, a flowchart illustrates steps performed on a process of sensor data evaluation. In step 605, any one of the sensor agent 20, user interface 35, or portable device 40 check the rules and determine whether or not they are still current. Specifically, rules generated by the different users may have specific lifetimes or may be tailored for specific times of the day. If the rules are no longer current, in step 610 the new rules will be retrieved from the look-up server. If the rules are current, in step 615 data is obtained from the work queue that has stored sensor data, as illustrated in FIG. 5 and discussed above. In 620, the data from the work queue is evaluated by using the rules. In 625, if the data is not outside the rule tolerance, the program returns to step 605 and checks for the current rules. Alternatively, if the data is outside the rule tolerances, then in step 630 an alarm is set and the alarm signal is transmitted to any one of, or all of the portable device 40, the sensor agent 20 or the user interface 35.

Figure 7:
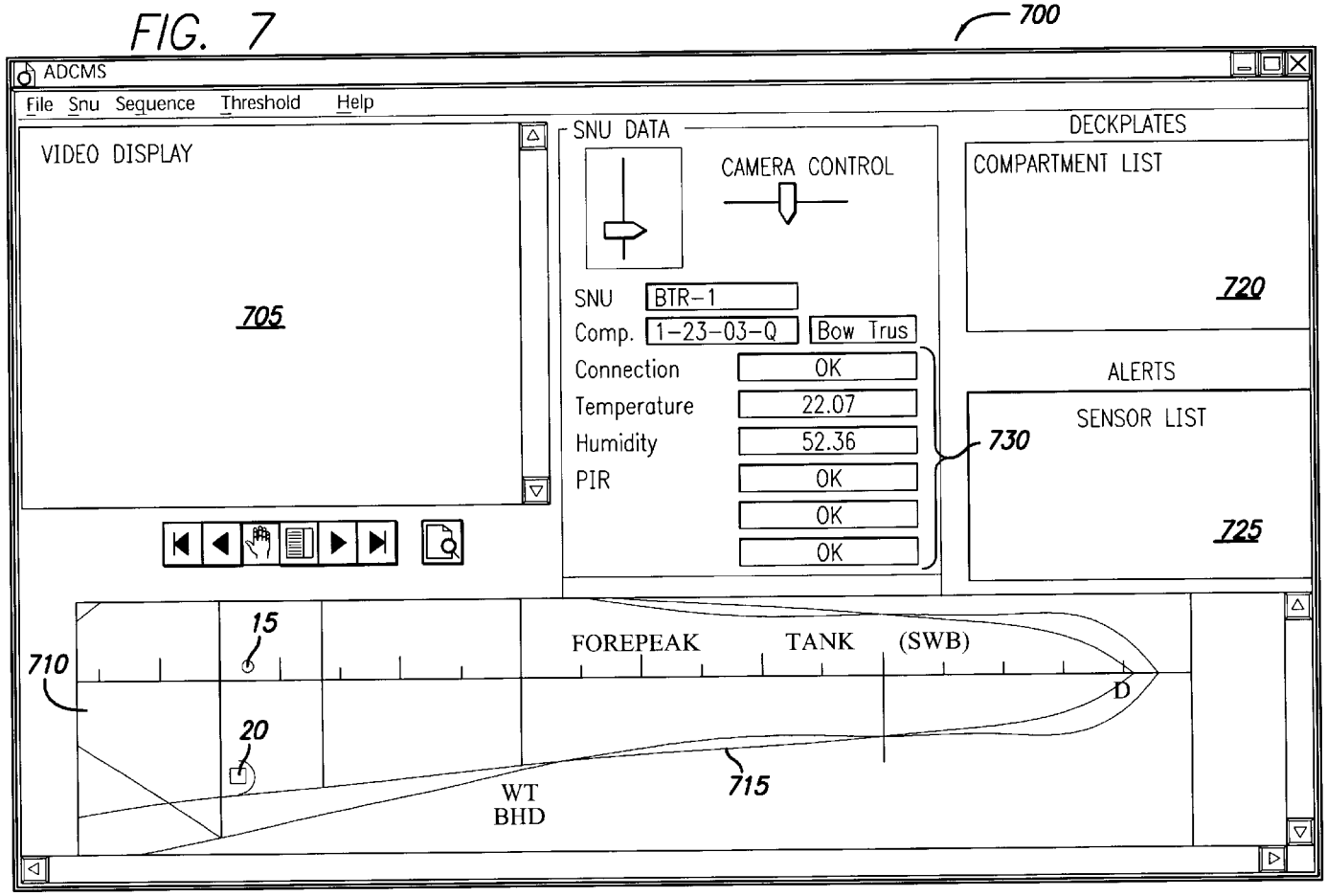
FIG. 7 depicts one embodiment of a graphical user interface.

Referring now to FIG. 7, a graphical user interface (GUI) 700 is illustrated. The GUI 700 may be part of the computer program that is one component of the environment monitoring system 10. The GUI 700 may be displayed on the user interface 35 or on the portable device 40. In one embodiment of the present invention, the GUI 700 may be "minimized" while other programs are running on the computer interface 35. However, when an alarm is received from any one of the sensors 15, the GUI 700 will be "maximized" so that a user will be alerted to the alarm condition.

The GUI 700 includes a video display area 705 that displays video received from the camera module 55 located on the sensor agent 20. In a preferred embodiment, the camera 60 can be directed from the user interface 35 so that different areas of a compartment can be viewed to verify an alarm condition. Also included in the GUI 700 is a structure diagram 710. The structure diagram 710 will depict the structure in which the environment monitoring system 10 is illustrated. For example, as shown in FIG. 7, a hull 715 of a ship is depicted. Also depicted in the structure diagram 710 are locations of sensor agents 20 and sensors 15. Using the structure diagram 710, a user can navigate throughout the structure or ship by selecting or "clicking on" a sensor 15 or sensor agent 20. A user can also navigate through a structure depicted in the structure diagram 710 by selecting specific compartments or rooms.

An alternative way of navigating around the ship or structure depicted in the structure diagram 710 is to access the specific room or compartment via the compartment list 720. The compartment list 720 will list each room or compartment in the building structure, train, subway or other vehicle or structure in which the environment monitoring system 10 is installed. A user can simply navigate to a desired room by selecting a room or compartment of interest. When a compartment or space is selected, the sensors 15 located in that compartment are listed in the sensor list 725. Sensor list 725 lists the sensors 15, sensor interfaces 25, and sensor agents 20 that are located in the selected compartment or space. Once the compartment is selected in compartment list 720, the sensor data is also portrayed on the sensor data list 730. For example, the sensor data list may include a connection status that would indicate whether the sensor agent 20 is communicating with the user interface 35, a temperature output, a humidity output, and other sensor data readings.

Another embodiment of the present invention may include an area on the GUI 700 that would recommend the activation of various damage suppression devices. The environment monitoring system 10 may also respond automatically to an alarm condition by automatically activating damage suppression devices. This activity may indicated on the GUI 700.

Thus, it is seen that an environment monitoring system is provided. One skilled in the art will appreciate that the present invention can be practiced by other than the preferred embodiments, which are presented in this description for purposes of illustration and not of limitation, and the present invention is limited only by the claims that follow. It is noted that various equivalents for the particular embodiments discussed in this description may practice the invention as well.

What is claimed is:

1. An environment monitoring system adapted to communicate with a plurality of preexisting sensors, comprising:

a user interface; and a plurality of sensor agents, each sensor agent structured to communicate with at least one other sensor agent, the user interface, and the plurality of preexisting sensors, at least one of the user interface and the plurality of sensor agents enabled to receive a plurality of rule sets for monitoring a plurality of environmental conditions corresponding to a plurality of interests of one or more users, at least one of the plurality of rule sets being different from at least another one of the plurality of rule sets.

2. The environment monitoring system of claim 1, wherein a sub-network is established by the communication between the plurality of sensor agents.

3. The environment monitoring system of claim 2, further comprising a portable device having a wireless communication capability structured to communicate with the plurality of sensor agents through the sub-network.

4. The environment monitoring system of claim 3, wherein the portable device is selected from the group consisting of: a portable digital assistant, a wireless phone, a laptop computer, and a portable computer, and any other portable device having a wireless communication capability.

5. The environment monitoring system of claim 1, further comprising a plurality of sensor interface devices, each sensor interface device communicating with at least one sensor agent and at least one preexisting sensor.

6. The environment monitoring system of claim 5, wherein the sensor interface device is structured to selectively receive analog and digital data from the preexisting sensor.

7. The environment monitoring system of claim 1, further including a camera coupled to each sensor agent.

8. The environment monitoring system of claim 7, wherein the camera is movable and can receive instructions selectively from the user interface and the sensor agents.

9. The environment monitoring system of claim 1, wherein the sensor agent monitors at least one preexisting sensor for an alarm.

10. The environment monitoring system of claim 1, wherein the sensor agent monitors a power status of each preexisting sensor.

11. The environment monitoring system of claim 1, wherein the sensor agent includes an internal power supply.

12. The environment monitoring system of claim 1, wherein the plurality of sensor agents are structured to be interchangeable so that a failed sensor agent can be replaced with another sensor agent.

13. The environment monitoring system of claim 1, further including a plurality of new sensors that are structured to communicate with the user interface and with at least one sensor agent.

14. The environment monitoring system of claim 1, wherein the preexisting sensors are selected from the group consisting of: temperature sensors, smoke sensors, explosive gas sensors, carbon monoxide sensors, chlorine gas sensors, nitrogen sensors, passive infrared sensors, water sensors, flooding sensors, atmospheric pressure sensors, and humidity sensors.

15. An environment monitoring system comprising:

a substantially stationary user interface;

a portable user interface; and a plurality of sensors structured to communicate with each other, with the substantially stationary user interface and with the portable user interface, at least one of the user interface and the portable user interface enabled to receive a plurality of rule sets for monitoring a plurality of environmental conditions corresponding to a plurality of interests of one or more users, at least one of the plurality of rule sets being different from at least another one of the plurality of rule sets.

16. The environment monitoring system of claim 15, wherein the communication between the plurality of sensors, the substantially stationary user interface and the portable user interface occurs selectively though a wired network and a wireless network.

17. The environment monitoring system of claim 15, wherein the plurality of sensors includes preexisting sensors.

18. The environment monitoring system of claim 15, further including a plurality of sensor interface devices, each sensor interface device communicating with at least one sensor agent and at least one sensor.

19. The environment monitoring system of claim 15, wherein the sensor agent communicates with at least one other sensor agent though a wireless network.

20. The environment monitoring system of claim 15, further including a camera coupled to each sensor agent.

21. The environment monitoring system of claim 20, wherein the camera is movable and can receive instructions from the substantially stationary user interface and the portable user interface.

22. The environment monitoring system of claim 15, wherein the portable user interface is selected from the group consisting of: a portable digital assistant, a wireless phone, a laptop computer, a portable computer, and any other portable device having a wireless communication capability.

23. The environment monitoring system of claim 15, wherein the substantially stationary user interface is selected from the group consisting of: desktop computers, computer workstations, computer servers, personal computers, and other substantially stationary devices.

24. An environment monitoring system comprising:

a plurality of sensors;

at least one user interface;

a plurality of sensor agents, each sensor agent structured to communicate with at least one other sensor agent, the user interface, and the plurality of sensors; and a processing unit selectively located on the user interface and the sensor agent, the processing unit configured to perform a plurality of steps including:

receiving a plurality of user-specific rules for monitoring a plurality of environmental conditions corresponding to a plurality of interests of one or more users, at least one of the plurality of user-specific rules being different from at least another one of the plurality of user-specific rules;

receiving sensor data from the plurality of sensors;

comparing the sensor data with the plurality of user-specific rules; and setting an alarm if the sensor data does not agree with one of the plurality of user-specific rules, the alarm being directed to a user who specified the one of the plurality of user-specific rules that did not agree with the sensor data.

25. The environment monitoring system of claim 24, wherein the processing unit receives the user-specific rule from a portable device.

26. The environment monitoring system of claim 24, wherein the processing unit receives a plurality of user-specific rules from a plurality of users.

27. The environment monitoring system of claim 26, wherein the processing unit compares the sensor data with each of the plurality of user-specific rules.

28. The environment monitoring system of claim 24, wherein the plurality of sensors includes preexisting sensors.

29. The environment monitoring system of claim 24, wherein the processing unit performs the additional step of providing a recommendation to the user by evaluating at least one of the sensor data, the alarm, and the user-specific rule.

30. The environment monitoring system of claim 24, wherein the processing unit performs the additional step of activating damage suppression devices.

31. The environment monitoring system of claim 24, wherein the user interface comprises a monitor and the processing unit graphically displays data obtained from the plurality of sensors.

32. The environment monitoring system of claim 31, wherein the graphical display comprises:

a video display;

a structure diagram;

a compartment list;

a sensor list; and a sensor data display.

33. The environment monitoring system of claim 32, wherein the structure is selected from the group consisting of: a ship, a building, a train, a subway, a factory, a power generating facility, and a spacecraft.

34. An environment monitoring system comprising:

a plurality of preexisting sensors communicating with at least one substantially stationary user interface over a first network; and a plurality of sensor agents, each sensor agent structured to communicate with at least one preexisting sensor, and with at least one other sensor agent over a second network that can be selectively accessed by a portable user interface and the substantially stationary user interface, at least one of the user interface and the plurality of sensor agents enabled to receive a plurality of rule sets for monitoring a plurality of environmental conditions corresponding to a plurality of interests of one or more users, at least one of the plurality of rule sets being different from at least another one of the plurality of rule sets.

35. The environment monitoring system of claim 34, further including a plurality of sensor interfaces, each sensor interface communicating with at least one sensor agent and at least one preexisting sensor.

36. The environment monitoring system of claim 34, wherein the first and second network is selectively wired and wireless.

37. An environment monitoring system, comprising:

a plurality of sensors;

a user interface;

a plurality of sensor agents, means for communication between the sensor agents, the user interface, and the plurality of sensors;

means for generating a plurality of user-specific rules for monitoring a plurality of environmental conditions corresponding to a plurality of interests of one or more users, at least one of the plurality of user-specific rules being different from at least another one of the plurality of user-specific rules;

means for receiving sensor data from the plurality of sensors;

means for comparing the sensor data with the plurality of user-specific rules; and means for setting an alarm if the sensor data does not agree with one of the plurality of user-specific rules, the alarm being directed to a user who specified the one of the plurality of user-specific rules that did not agree with the sensor data.

38. The environment monitoring system of claim 37, further comprising means for generating the user-specific rule from a portable device.

39. The environment monitoring system of claim 37, further comprising means for receiving a plurality of user-specific rules from a plurality of users.

40. The environment monitoring system of claim 39, further comprising means for comparing the sensor data with each of the plurality of user-specific rules.

41. The environment monitoring system of claim 37, wherein the plurality of sensors includes preexisting sensors.

42. The environment monitoring system of claim 37, further including means for providing a recommendation to the user by evaluating at least one of the sensor data, the alarm, and the user-specific rule.

43. The environment monitoring system of claim 37, further including means for activating damage suppression devices.

44. The environment monitoring system of claim 37, further comprising means for graphically displaying data obtained from the plurality of sensors.

45. A method of communicating with a plurality of preexisting sensors, the method comprising the steps of:

communicating with the plurality of preexisting sensors over a first network; and providing a plurality of sensor agents, each sensor agent communicating with at least one preexisting sensor, and with at least one other sensor agent over a second network, at least one of the user interface and the plurality of sensor agents enabled to receive a plurality of rule sets for monitoring a plurality of environmental conditions corresponding to a plurality of interests of one or more users, at least one of the plurality of rule sets being different from at least another one of the plurality of rule sets.

46. The method of claim 45, wherein the second network can be accessed by a portable user interface.

* * * * *